US011272301B2

(12) United States Patent
Myers et al.

(10) Patent No.: US 11,272,301 B2
(45) Date of Patent: Mar. 8, 2022

(54) MEASURING LOUDSPEAKER NONLINEARITY AND ASYMMETRY

(71) Applicant: Parts Express International, Inc., Springboro, OH (US)

(72) Inventors: Brian K. Myers, Springboro, OH (US); John L. Murphy, Andersonville, TN (US)

(73) Assignee: Parts Express International, Inc., Springboro, OH (US)

( * ) Notice: Subject to any disclaimer, the term of this patent is extended or adjusted under 35 U.S.C. 154(b) by 0 days.

(21) Appl. No.: 16/739,232

(22) Filed: Jan. 10, 2020

(65) Prior Publication Data

US 2020/0228906 A1 Jul. 16, 2020

Related U.S. Application Data

(60) Provisional application No. 62/790,769, filed on Jan. 10, 2019.

(51) Int. Cl.
*H04R 29/00* (2006.01)
*H04R 3/00* (2006.01)
*H04R 3/04* (2006.01)

(52) U.S. Cl.
CPC ..... *H04R 29/001* (2013.01); *H04R 3/04* (2013.01)

(58) Field of Classification Search
CPC .... H04R 29/00; H04R 29/001; H04R 29/003; H04R 3/00; H04R 3/007; H04R 3/04; H04R 3/08
See application file for complete search history.

(56) References Cited

U.S. PATENT DOCUMENTS 6,584,204 B1 6/2003 Al-Ali et al.
10,123,116 B2 * 11/2018 Bjork ..... H04R 3/007
2002/0161543 A1 * 10/2002 Yoshino ..... H04R 5/04 702/111
2005/0195993 A1 * 9/2005 Kwon ..... H03G 9/025 381/102
2006/0126857 A1 * 6/2006 Pavlov ..... H04R 29/003 381/59
2008/0304627 A1 * 12/2008 Kim ..... H04M 1/24 379/27.03
2011/0299691 A1 * 12/2011 Yoshino ..... H04R 29/00 381/59

(Continued)

OTHER PUBLICATIONS

Klippel et al., Measurement and Visualization of Loudspeaker Cone Vibration; Audio Engineering Society Convention Paper 6882; Oct. 1, 2006.

(Continued)

*Primary Examiner* — Thang V Tran
(74) *Attorney, Agent, or Firm* — Wood Herron & Evans LLP

(57) ABSTRACT

Loudspeaker parameters are measured separately for various forward and rearward cone displacements, using a test signal that permits measurement of parameters at various degrees of either forward or rearward cone movement. The test signal uses a brief frequency sweep signal such as a logarithmic sweep signal, in combination with a very low frequency (VLF) audio tone having a fundamental frequency below, e.g., 10 Hz. The very low frequency audio tone may have a sine wave shape, a square wave shape or a clipped sine wave shape.

18 Claims, 4 Drawing Sheets

(56) References Cited

U.S. PATENT DOCUMENTS

| | | | | |
|---|---|---|---|---|
| 2012/0224701 | A1* | 9/2012 | Sakai | H04S 7/301 381/17 |
| 2013/0051572 | A1* | 2/2013 | Goh | H04S 7/302 381/59 |
| 2013/0064042 | A1 | 3/2013 | Aarts et al. | |
| 2013/0251164 | A1* | 9/2013 | Gautama | H04R 3/002 381/59 |
| 2015/0023509 | A1 | 1/2015 | Devantier et al. | |
| 2015/0029112 | A1* | 1/2015 | Macours | H03K 17/96 345/173 |
| 2015/0030169 | A1* | 1/2015 | Pan | H04R 29/001 381/59 |
| 2015/0039313 | A1* | 2/2015 | Seyfetdinov | G10L 17/08 704/246 |
| 2015/0124982 | A1* | 5/2015 | Berthelsen | H04R 29/001 381/59 |
| 2016/0119715 | A1 | 4/2016 | Ozcan | |
| 2016/0309270 | A1* | 10/2016 | Miller | G06F 3/165 |
| 2016/0373871 | A1 | 12/2016 | Ronig et al. | |
| 2018/0367897 | A1 | 12/2018 | Bjork et al. | |
| 2019/0028805 | A1* | 1/2019 | Goto | H04R 3/007 |
| 2019/0068152 | A1* | 2/2019 | Gautama | H03G 3/3005 |

OTHER PUBLICATIONS

Klippel et al.; Loudspeaker Nonlinearities—Causes, Parameters, Symptoms; Audio Engineering Society Convention Paper 6584; Oct. 1, 2005.

Dodd et al.; Voice Coil Impedance as a Function of Frequency and Displacement; Audio Engineering Socity Convention Paper 6178; Oct. 1, 2004.

Klippel; Prediction of Speaker Performance at High Amplitudes; Audio Engineering Society Convention Paper 5418; Nov. 1, 2001.

Klippel; Nonlinear Large-Signal Behavior of Electrodynamic Loudspeakers at Low Frequencies; J Audio Eng. Socl, vol. 40, No. 6, Jun. 1992.

Klippel et al; Fast and Accurate Measurement of Linear Transducer Parameters; Audio Engineering Society Convention Paper, May 2001.

Klippel; Dynamic Measurement and Interpretation of the Nonlinear Parameters of Electrodynamic Loudspeakers; J. Audio Eng. Soc., vol. 38, No. 12, Dec. 1990.

Klippel; Distortion Analyzer—a New Tool for Assessing and Improving Electrodynamic Transducer; Audio Engineering Society Convention Paper; Feb. 2000.

Klippel; Diagnosis and Remedy of Nonlinearities in Electrodynamical Transducers; Audio Engineering Convention; Sep. 2000.

Dobrucki et al.; Simulation and measurement of loudspeaker nonlinearity with a broad-band noise excitation; Soci été Française d'Acoustique. Acoustics 2012, Apr. 2012.

Gander; Dynamic Linearity and Power Compression in Moving-Coil Loudspeakers; Audio Engineering Society Convention Paper; Oct. 1984.

Farina; Simultaneous Measurement of Impulse Response and Distortion with a Swept-Sine Technique; Audio Engineering Socieity Convention Paper; Feb. 2000.

Perazella; Beyond Thiele/Small—Dumax and Klippel Driver Measurement Systems; Product Review, AudioXpress, Mar. 2003; pp. 50-59.

Clark; Precision Measurement of Louspeaker Parameters; Audio Engineering Society Convention Paper; Oct. 1995.

Klippel Gmbh Application Note to Klippel Analyzer System/AN17; Credibility of Nonlinear Parameter Measurement; Mar. 2003.

Tsai et al.; Precision Identification of Nonlinear Damping Parameter for a Miniature Moving-Coil Transducer; World Academy of Science, Engineering and Technology, International Journal of Electrical and Computer Engineering; vol. 7, No. 7, 2013.

PCT/US20/13079 International Search Report and Written Opinion dated Apr. 24, 2020.

* cited by examiner

MEASURING LOUDSPEAKER NONLINEARITY AND ASYMMETRY

RELATED APPLICATION

The present invention claims benefit of U.S. Provisional Patent Application Ser. No. 62/790,769 filed Jan. 10, 2019, which is incorporated herein in its entirety.

FIELD OF THE INVENTION

The invention is generally directed to speakers, and in particular to testing speakers for defects that may cause distortion in the sound produced thereby.

BACKGROUND OF THE INVENTION

Speakers vary greatly in their components and composition, with the most common using a lightweight diaphragm (or "cone") connected to a rigid basket (or "frame") via a flexible suspension that constrains a coil of fine wire (a "voice coil") to move axially through a cylindrical magnetic gap. When an electrical signal is applied to the voice coil, a magnetic field is created by the electric current in the voice coil, making it a variable electromagnet. The coil and the magnetic system interact, generating a mechanical force that causes the coil (and thus, the attached cone) to move back and forth, thereby reproducing sound under the control of the applied electrical signal.

Despite significant advances in the materials that are used to make speakers as well as advances in the construction of speakers themselves, they remain electro-mechanical devices prone to failure and substandard performance. Speaker failure can occur due to misalignment of the magnetic system of the speaker, but often occurs upon the introduction of a foreign object to the speaker, such as between the voice coil and the gap, reducing the ability of the voice coil to move back and forth. Such foreign objects can include dust, ferrous debris, non-ferrous debris, and general detritus that exists in various environments. The failure of a speaker, in turn, can entail significant repair costs, as speakers have become ubiquitous in cars, computers, phones, and any other device that generates or relays sound, but are often considered the most stable and thus placed in areas that are labor-intensive to reach.

Speakers are therefore often tested for defects prior to installation to reduce the likelihood of replacement due to foreign objects that are introduced to the speakers from manufacturing, storage, or some other condition. Conventional speaker tests include connecting a speaker to the electrical signal and audibly measuring the sound produced thereby with a microphone. If the sound from a speaker is sufficiently clear (e.g., the sound does not exhibit much distortion), the speaker passes and may be used. Contrariwise, if the sound from the speaker exhibits too much distortion, the speaker is deemed unfit for use and rejected for poor quality.

However, testing speakers in this manner is often very time consuming, as various tones must be produced for the testing apparatus and there is little way to account for distortion introduced by the microphone. Moreover, the failure of speakers due to contamination by foreign objects often takes time to manifest. Specifically, a foreign object may not noticeably degrade the sound from a speaker when first introduced, but as the speaker is used the foreign object can degrade the components of the speaker till such a time that the sound from the speaker is unacceptable.

The Dayton Audio Test System (DATS), which is sold by the assignee of the present invention, drives a loudspeaker with a very brief (0.7 second) logarithmic frequency sweep signal to perform a high resolution impedance measurement. This frequency sweep test signal 100 is shown in FIG. 2. Using the output of the speaker when driven with the frequency sweep test signal, the DATS software can derive very detailed parameters specifying the characteristics of the loudspeaker in a standard fashion that is useful to anyone concern with the loudspeaker specification and performance.

DATS drives a loudspeaker with a sweep one time to measure the loudspeaker's free air performance and parameters, and then repeats the sweep to measure various loudspeaker electromechanical parameters such as Fs, Qts and Vas. Before this second sweep the user is typically asked to either place the speaker in a test box or add a test mass to the cone to allow parameter measurement.

Small-signal measurement systems like DATS can be used to perform basic large-signal analysis of a loudspeaker by adding a power amplifier to the DATS system output to drive the loudspeaker under test. This allows the loudspeaker to be driven up to and possibly beyond the limits of normal usage. Generating the test sweep at increasingly higher amplitudes in this way makes it possible to measure a full set of speaker parameters at each power level tested. This method provides a measure of the parameter variations as the loudspeaker drive level is increased.

FIG. 3 shows a test sweep 110 produced at increasing signal levels 112, 114, 116 in accordance with the method just described. The signal level represented in FIG. 2 is the output voltage from the power amplifier which is driving the loudspeaker under test. (The DATS measurement software can convert the drive voltage to input power or cone excursion, as preferred by the user.)

The DATS software can, in the described way, measure the parameters automatically at several signal levels using successive sweeps at progressively greater amplitudes. The measurement results can then be presented to the user as a table showing driver parameters for each drive level. Alternately, each speaker parameter can be plotted as a function of drive voltage, input power or average cone excursion to show how the parameter changes with drive level. Note that the method of increasing signal amplitude described above measures does not account for the polarity of cone displacement.

Another historically known method for measurement of large-signal loudspeaker parameters involves forcibly displacing the cone during testing. One several methods can be used to displace the cone, including applying air pressure to the cone in a pressure/vacuum chamber, coupling an attachment to the cone to apply force to displace the cone, or applying direct current (DC) to the voice coil. The cone displacement can be measured directly (such as with a scale) or by using a separate laser-based instrument. With the cone displaced the impedance is can be measured and parameters extracted from the impedance measurements by a computer software routine. One well known source for such non-linear test equipment is Klippel GmbH of Germany.

While the foregoing methods exist, neither is completely satisfactory for testing loudspeakers in large-signal operation. The methods using DATS involve multiple signal generation and plotting steps and does not account for the polarity of cone displacement. The methods involving forcible displacement of the cone require that the loudspeaker be used in a way that diverges from conventional operation, either through the attachment of external pressure or displacement or the use of DC currents.

Thus, a need continues to exist in the art for a manner of testing speakers for defects that does not suffer from the drawbacks detailed above.

SUMMARY OF THE INVENTION

Embodiments consistent with the invention include a method, apparatus, and program product to measure loudspeaker parameters separately for various forward and rearward cone displacements. Measuring parameters for forward cone displacement separately from the parameters measured for rearward cone displacements will reveal asymmetry in the BI, CMS, FS, QTS, LE and other parameters thus aiding driver designers in optimizing their drivers for maximum sound output capability from the driver before the onset of overload distortion.

In accordance with principles of the present invention, a novel test signal is used to measure parameters at various degrees of either forward or rearward cone movement. The test signal uses a brief frequency sweep signal such as the logarithmic sweep signal as currently used in DATS, in combination with a very low frequency (VLF) audio tone having a fundamental frequency below 10 Hz.

In detailed embodiments, the very low frequency tone can have a fundamental frequency below 5 Hz, or below 1 Hz, and in one embodiment the tone may have a fundamental frequency of 0.1 Hz. In the detailed embodiments the very low frequency audio tone may have a sine wave shape, a square wave shape or a clipped sine wave shape.

In specific embodiments, the test signal further comprises a logarithmic frequency sweep signal which is combined with the very low frequency tone. Additionally, the very low frequency tone may be applied at a plurality of amplitudes.

In further aspects the invention features a test apparatus for testing a loudspeaker, comprising an audio band output having electrical output terminals for connection to the loudspeaker, an audio band input, at least one processing unit, and a memory, the memory containing program code configured to be executed by the at least one processing unit to output a test signal to the electrical output terminals, wherein the test signal comprises a very low frequency tone, to receive a measured signal at the audio band input, and to compare the test signal and measured signal and extract loudspeaker parameters.

In specific embodiments, the test apparatus employs an audio power amplifier with extended low frequency response to approximately 0.2 Hz.

In a further aspect, the invention features a program product, comprising program code that is configured to perform the described method and activate the described test apparatus to test a loudspeaker. The program code causes a processor to produce a test signal comprising a very low frequency tone, receive a measured signal representing the sound produced by the loudspeaker, and extract the parameters of the loudspeaker for various degrees of both forward and rearward cone excursion.

The invention thus permits testing a loudspeaker for non-linearities at various drive levels, and tests performed in distinct cases of forward cone motion and rearward cone motion by causing excursion of the loudspeaker cone with a test signal including a very low frequency tone applied at the electrical terminals of the loudspeaker.

BRIEF DESCRIPTION OF THE DRAWINGS

The foregoing aspects and details embodiments of the invention will be further understood by reference to the drawings appended hereto, in which.

DETAILED DESCRIPTION OF THE INVENTION

Figure 1:
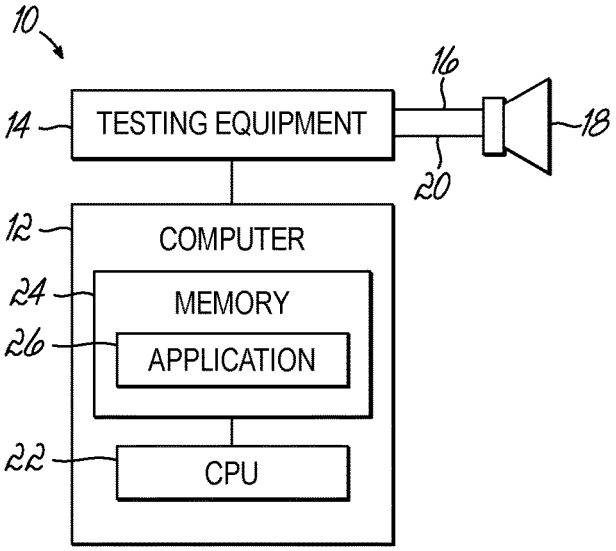
FIG. 1 is an illustration of a testing system consistent with embodiments of the invention.

FIG. 1 is an illustration of a testing system 10 consistent with embodiments of the invention. In particular, the testing system includes a computer 12 connected to testing equipment 14 that is configured to provide one or more signals via electrical output terminals at 16 to a speaker 18. The testing equipment 14 is further configured to measure characteristics of one or more audio band signals produced by the loudspeaker via a connection 20.

In particular, the computer 12 may include at least one computer, computer system, computing device, server, disk array, or programmable device such as a multi-user computer, a single-user computer, a handheld device, a networked device (including a computer in a cluster configuration), etc. The computer 12 includes at least one central processing unit ("CPU") 22 coupled to a memory 24. CPU 22 is typically implemented in hardware using circuit logic disposed in one or more physical integrated circuit devices, or chips, and may be one or more microprocessors, microcontrollers, field programmable gate arrays, or ASICs, while memory 24 may include random access memory (RAM), dynamic random access memory (DRAM), static random access memory (SRAM), flash memory, EEPROM and/or another digital storage medium, and is typically implemented using circuit logic disposed on one or more physical integrated circuit devices, or chips. As such, memory 24 may be considered to include memory storage physically located elsewhere in the computer 12, e.g., any cache memory in the at least one CPU 22, as well as any storage capacity used as a virtual memory.

The computer 12 is under the control of an operating system (not shown) and executes or otherwise relies upon various computer software applications, components, programs, files, objects, modules, etc. (illustrated as "Application" 26). The application 26, in turn, is configured to control the testing equipment 14 to send signals to, and measure characteristics of signals from, the speaker 18. The testing equipment 14 may be connected to the computer 12 through a Universal Serial Bus ("USB") connection, and, in specific embodiments, may be a Dayton Audio Test System (DATS) speaker tester as distributed by Parts Express International, Inc., of Springboro, Ohio. In specific embodiments, application 26 may be DATS software also distributed by Parts Express and configured to interoperate with the testing equipment 14 when such testing equipment is the DATS speaker tester.

Figure 2:
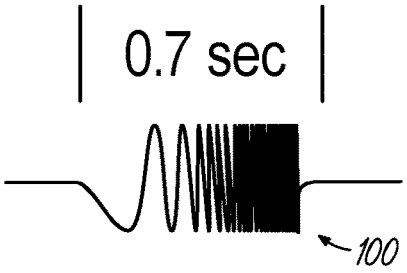
FIG. 2 is an illustration of a logarithmic frequency sweep test signal.
Figure 3:
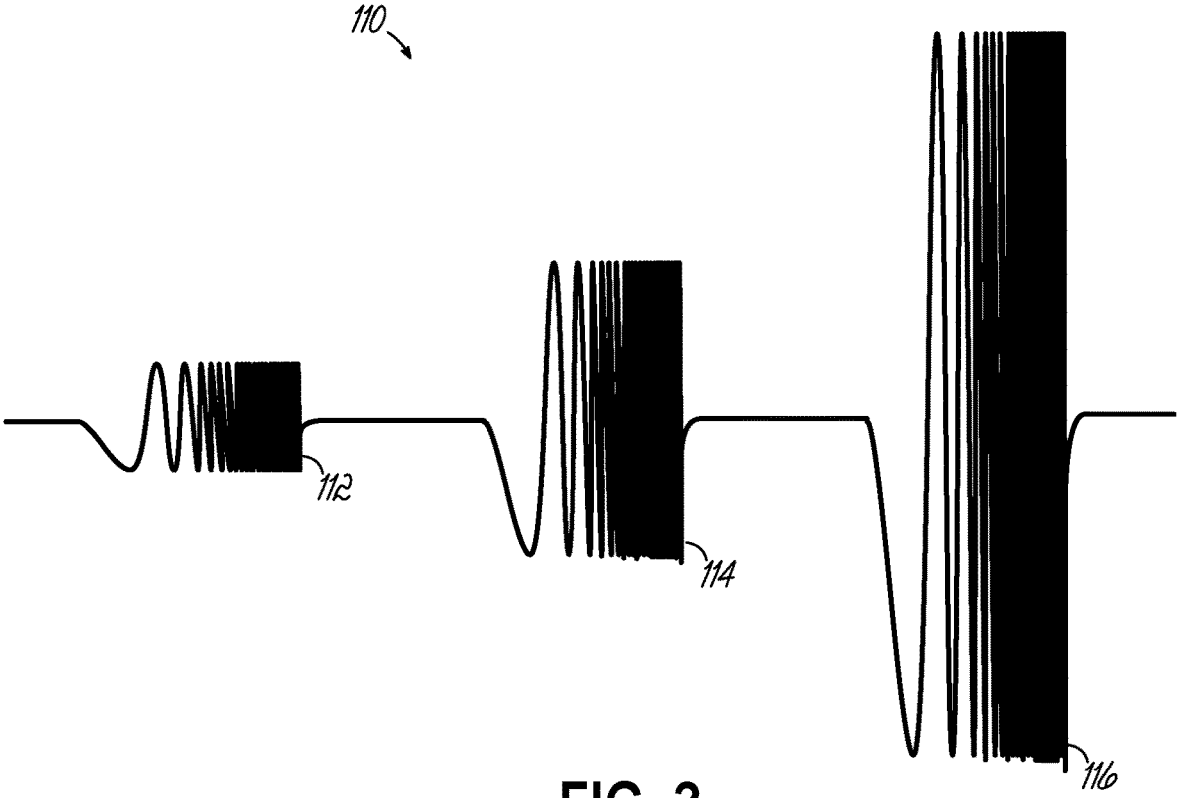
FIG. 3 is an illustration of a series of logarithmic frequency sweep test signals at increasing amplitudes.

FIG. 2, discussed above, illustrate a logarithmically swept frequency test signal 110, usable as a component of the present invention herein.

Figure 4:
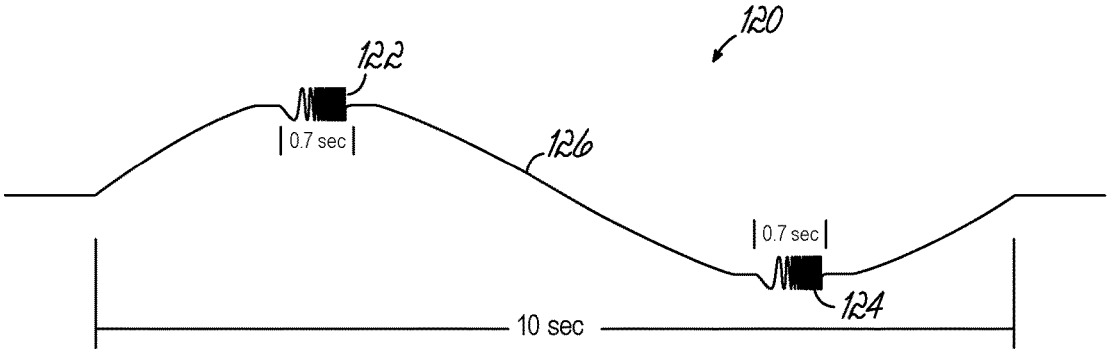
FIG. 4 is an illustration of one embodiment of a novel test signal in accordance with principles of the present invention, comprising a very low frequency sine wave combined with a frequency sweep signal.

FIG. 4 is an illustration of one embodiment of a novel test signal 120 produced by the system 10 in accordance with principles of the present invention, comprising a very low frequency sine wave 126 combined with frequency sweep signals 122, 124. In this signal, the logarithmic frequency sweep signal 112 and 124 conventionally used in DATS, which is brief in duration (0.7 sec), is combined with a very low frequency (VLF) tone 126 so that the combination tone can then be used to measure the impedance at the separate positive and negative peaks of the VLF tone. Impedance measurements sufficient to extract speaker parameters are performed separately at the positive and negative peak of the single-cycle VLF waveform. Using this "sweep plus VLF tone" method, the system 10 can calculate the driver's parameters separately for each signal polarity over a wide range of VLF levels and corresponding cone excursions. By varying the VLF signal level the system 10 can control the cone displacement at the time the measurement is made and thus measure the driver parameters for various forward and rearward cone displacements.

In the illustrated case, the very low frequency (VLF) tone is a sine wave 126 at 0.1 Hz, having a period of 10 seconds. This VLF wave 126 has positive and negative peaks which are long enough to generate and acquire a sweep 122 and 124 at each peak of the VLF tone. The sweep can be repeated with the VLF amplitude incremented, resulting in a series of measurements that capture the impedance response of the loudspeaker over a range of cone displacements. The application 26 then analyzes each captured impedance sweep and calculate parameters for that particular excursion and polarity.

To implement this method testing equipment 14 incorporates a power amplifier that can reliably deliver the specified VLF test signal to a speaker. Experience with analog power amplifiers suggests that when they are driven with high power signals much below 20 Hz the result can be excessive thermal dissipation and potential failure. Thus, a power amplifier must be selected that can operate far below 20 Hz without failing. An off-the-shelf audio power amplifier was appropriately modified in order to extend its response below 0.1 Hz (as most audio amplifiers are limited to around 5-10 Hz). Very extended low frequency response can pose a safety hazard to the unit under test if switching transients are not handled carefully. In order to minimize the driver safety issue, the amplifier low-frequency bandwidth should be extended only as low as necessary to pass the test signal.

The VLF sine wave shown in FIG. 4 slowly shifts between the peak displacement levels of the sweep. A long duration VLF cycle has a lower fundamental frequency, requiring a power amplifier with a similar or lower cutoff frequency. In order to raise this low frequency cutoff, the VLF period (cycle time) can be made as short as possible while cleanly acquiring the test sweep.

Figure 5:
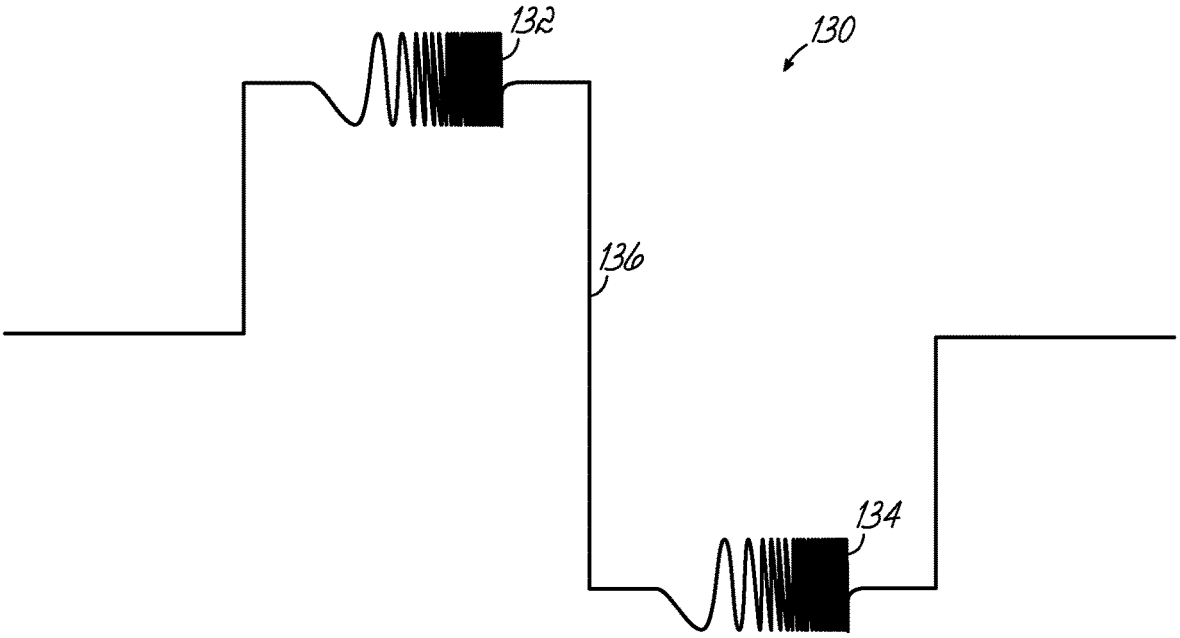
FIG. 5 is an illustration of a second embodiment of a novel test signal in accordance with principles of the present invention, comprising a very low frequency square wave combined with a frequency sweep signal.

FIG. 5 is an illustration of a second embodiment of a novel test signal 130 in accordance with principles of the present invention, in which the very low frequency is a square wave 136 combined with frequency sweep signals 132 and 134. This VLF signal 136 has a substantially faster transition between peak levels (peak cone excursion) than the sine wave shown in FIG. 4, but may produce a very loud and abusive "click" at each vertical segment of the waveform.

Figure 6:
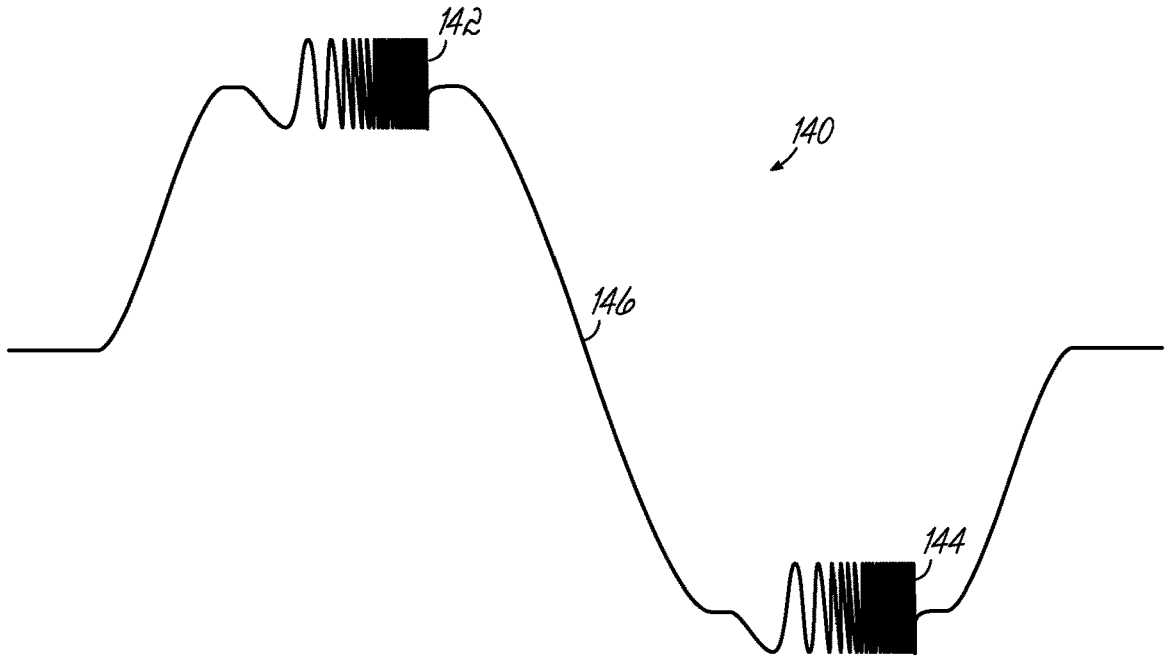
FIG. 6 is an illustration of a third embodiment of a novel test signal in accordance with principles of the present invention, comprising a very low frequency waveform in the form of a clipped sine wave, combined with a frequency sweep signal during the clipped peaks of the very low frequency waveform.

FIG. 6 is an illustration of a third embodiment of a novel test signal 140 in accordance with principles of the present invention, comprising a very low frequency waveform 146 in the form of a clipped sine wave, combined with frequency sweep signals 142 and 144 during the clipped peaks of the very low frequency waveform. This VLF waveform uses sine wave segments at the beginning, center, and end of the waveform in order to achieve fast but smooth transitions between base levels of the test signal, but the sine wave shape is clipped to a maximum and minimum value. This VLF period is much shorter than the sine wave of FIG. 4 and is almost as brief as the square wave of FIG. 5, but without annoying loud clicks.

Using the VLF and frequency sweep signals described herein, comprehensive testing of a loudspeaker may be efficiently performed. More specifically, the testing equipment 14 is configured to provide a plurality of drive signals to the speaker 18 (e.g., such as frequency sweeps and VLF signals at multiple voltage levels) and measure the voltages provided from the speaker 18 in response to those drive signals. The testing equipment 14 or, alternatively, the application 26, then calculates the complex impedance or resistance of the speaker 18 for each particular drive signal based on data about the voltage and/or current from the speaker 18 at the level of that drive signal. The application 26 subsequently determines whether the resonant frequencies or resistances at the various drive levels shift unacceptably as the drive levels vary, or whether peaks of the resonant frequencies or resistances at the various drive levels increase or decrease unacceptably as the drive levels vary.

By way of example, shifts in the resonant frequencies of the complex impedances beyond a frequency threshold or shifts in the peaks of the complex impedances beyond a peak threshold indicate that a speaker 18 may not be functioning properly. Such shifts may be caused by incorrectly aligned components of the speaker 18, component failure of the speaker 18, or unsuitable components for the speaker 18, but are generally caused by foreign objects introduced to the speaker 18. These foreign objects can cause buzz and rub in the sound produced by the speaker 18 but may not be audible or detectable using conventional testing methodologies. However, the foreign objects in the speaker 18 also often change the resistance and complex impedances of the speaker 18 at its resonant frequency.

Thus, embodiments of the invention determine the resonant frequency of the speaker 18 at various drive levels and determine the corresponding complex impedances, then analyze those complex impedances or resistances to determine loudspeaker parameters and whether the speaker 18 is acceptable.

In one embodiment, the application 26 may be configured to reject a speaker 18 when the shift in the resonant frequencies of the drive levels exceeds a target frequency threshold. In some embodiments, the target frequency threshold may be set to about 500% more or less than the resonant frequency when the drive signal is at 0 dBu. However, in alternative embodiments, the target frequency threshold may be set lower, such as from about 30% to about 40%, which provides an acceptable range in which the resonant frequencies of the complex impedances of the various drive signals may vary. In still further alternative embodiments, the shift in the resonant frequency at a particular cone excursion may be determined with respect to the resonant frequency of a previous or subsequent drive signal. In those embodiments, when there is a shift in the resonant frequency from a first drive signal to a second drive signal that meets or exceeds the target frequency threshold, the speaker 18 may be rejected. One having ordinary skill in the art will appreciate that the target frequency threshold may be user-defined, and thus include different ranges or values than those disclosed above.

In additional or alternative embodiments, the application 26 is configured to reject a speaker 18 when the shift in the magnitude of the peaks of the complex impedance at the resonant frequencies of the drive levels exceeds a target peak threshold. In some embodiments, the target peak threshold may be set from about 100% to about 150% more or less than the peak of the complex impedance at the resonant frequency when the drive signal is at 0 dBu. In still further alternative embodiments, the peak of the complex impedance at the resonant frequency of a particular cone excursion may be determined with respect to the peak of the complex impedance at the resonant frequency of a previous or subsequent cone excursion. In those embodiments, when there is a shift in the peak from a first drive signal to a second drive signal that meets or exceeds the target peak threshold, the speaker 18 may be rejected. One having ordinary skill in the art will appreciate that the target peak threshold may be user-defined, and thus include different ranges or values than those disclosed above. In still further embodiments, the impedance data from the speaker under test are compared to the data from a known good reference speaker. By using data from a known good speaker for the first (reference) impedance measurement a speaker under test can be screened with a single sweep thereby, providing increased efficiency for continuous production testing.

The routines executed to implement embodiments of the invention, whether implemented as part of an operating system or a specific application, component, program, object, module, or sequence of instructions executed by a computer 12 or testing equipment 14 will be referred to herein as a "sequence of operations," a "program product," or, more simply, "program code." The program code typically comprises one or more instructions that are resident at various times in various memory and storage devices, and that, when read and executed by one or more processing units, such as CPU 22 of the computer 12 or a processing unit (not shown) of the testing equipment 14, cause that computer 12 or testing equipment 14 to perform the steps necessary to execute steps, elements, and/or blocks embodying the various aspects of the invention by thus using the processor(s).

A person having ordinary skill in the art will appreciate that the various aspects of the present invention are capable of being distributed as a program product in a variety of forms, and that the invention applies equally regardless of the particular type of computer readable signal bearing media used to actually carry out the distribution. Examples of computer readable signal bearing media include but are not limited to physical and tangible recordable type media such as volatile and nonvolatile memory devices, floppy and other removable disks, hard disk drives, optical disks (e.g., CD-ROM's, DVD's, BLU-RAY's, etc.), among others.

In addition, various program code described hereinafter may be identified based upon the application or software component within which it is implemented in. However, it should be appreciated that any particular program nomenclature that follows is used merely for convenience, and thus the invention should not be limited to use solely in any specific application identified and/or implied by such nomenclature. Furthermore, given the typically endless number of manners in which computer programs may be organized into routines, procedures, methods, modules, objects, and the like, as well as the various manners in which program functionality may be allocated among various software layers that are resident within a typical computer (e.g., operating systems, libraries, APIs, applications, applets, etc.), it should be appreciated that the invention is not limited to the specific organization and allocation of program functionality described herein.

Figure 7:
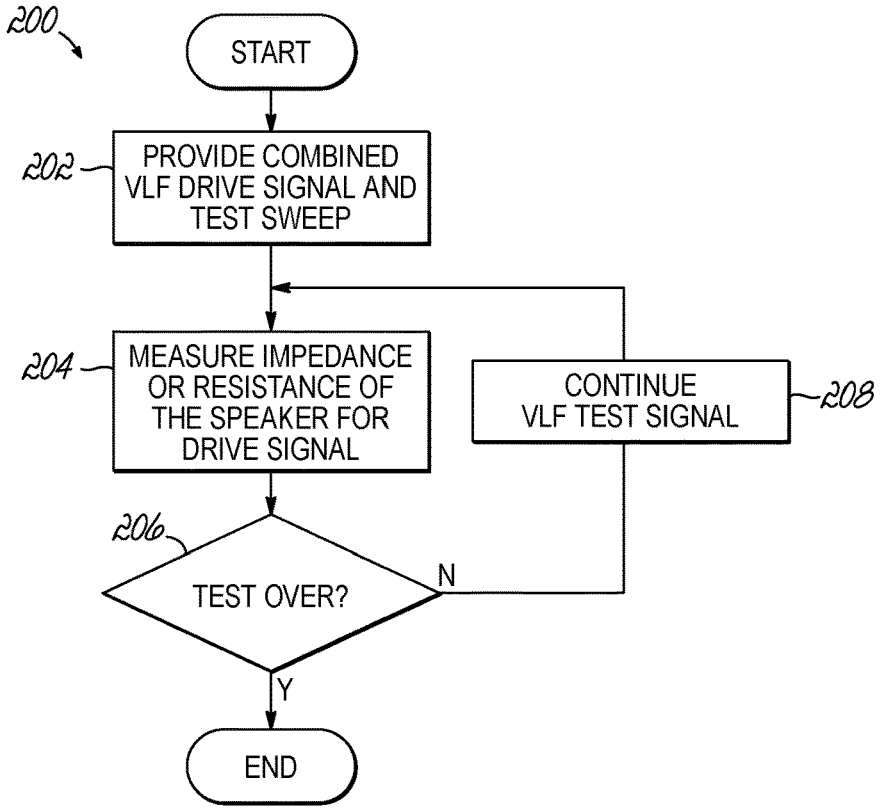
FIG. 7 is a flowchart illustrating a sequence of operations to provide drive signals for the loudspeaker of FIG. 1 consistent with embodiments of the invention.

FIG. 7 is a flowchart 200 illustrating a sequence of operations to provide drive signals for the speaker 18 consistent with embodiments of the invention. In some embodiments, the sequence of operations of FIG. 7 may be performed by the computer 12, by testing equipment 14 under control of the computer 12, or independently by the testing equipment 14. In any event, when a user has selected to begin testing of the speaker 18, the computer 12 or testing equipment 14 provides an initial drive signal (e.g., a swept sine wave signal of a particular magnitude that sweeps across a range of frequencies) (block 202) and measures the impedance or resistance of the speaker 18 for the drive signal (block 204). The computer 12 or testing equipment 14 then determines whether the test is over (block 206). When the test is not over ("No" branch of decision block 206), the computer 12 or testing equipment 14 increments or decrements the magnitude of the drive signal (block 208) and the sequence of operations returns to block 204. When the test is over ("Yes" branch of decision block 206), the sequence of operations may end.

Figure 8:
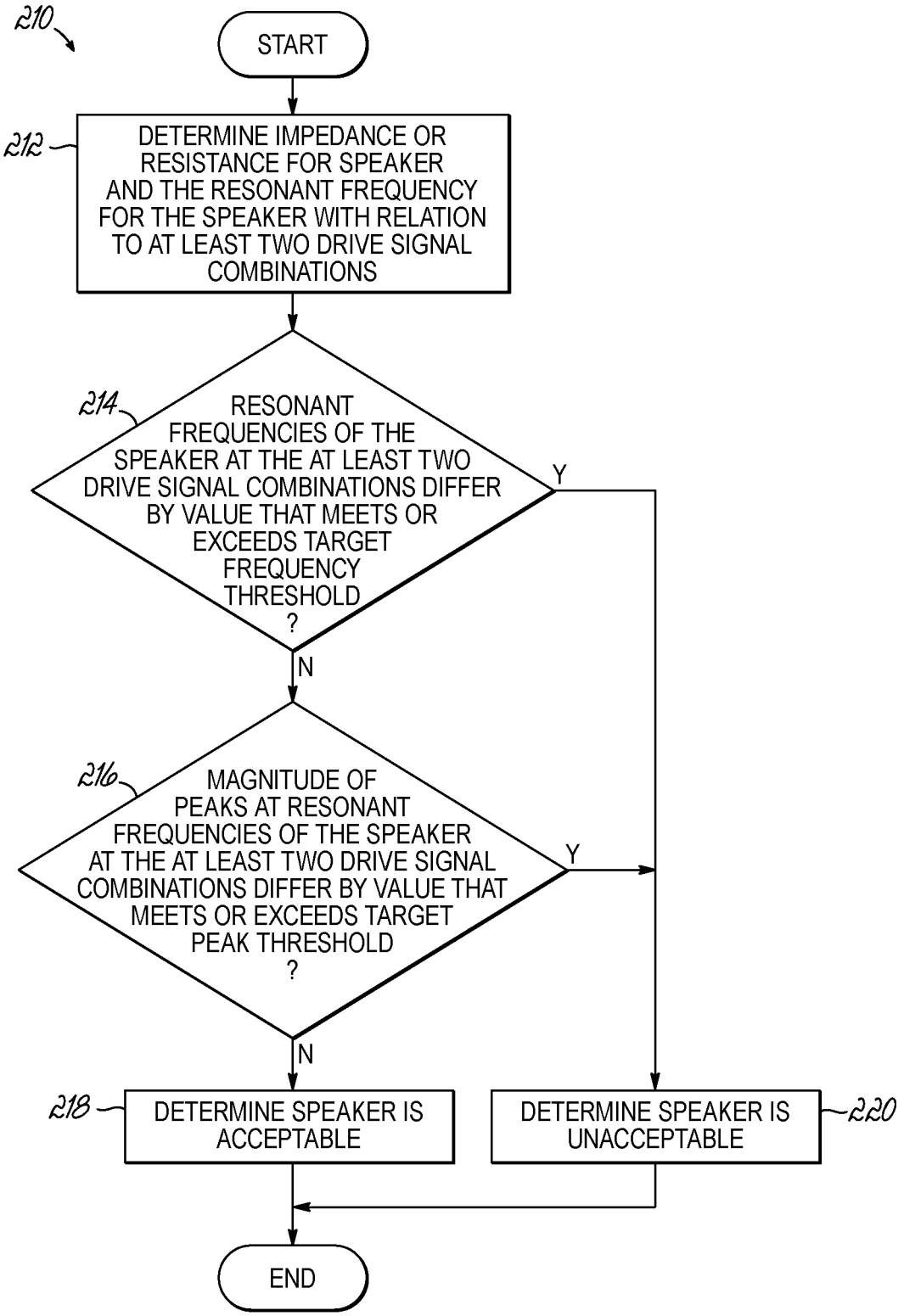
FIG. 8 is a flowchart illustrating a sequence of operations to determine whether the loudspeaker of FIG. 1 is acceptable based upon the various impedances or resistances of the loudspeaker determined from corresponding drive signals.

FIG. 8 is a flowchart 210 illustrating a sequence of operations to determine whether the speaker 18 is acceptable based upon the various impedances or resistances of the speaker 18 determined from corresponding drive signals. In some embodiments, the sequence of operations of FIG. 8 may be performed by the computer 12, by testing equipment 14 under control of the computer 12, or independently by the testing equipment 14. In any event, the computer 12 or testing equipment 14 determines an impedance or resistance for the speaker 18 as well as the resonant frequency for the speaker 18 with relation to at least two drive signals (e.g., determining the resonant frequency at each drive signal and the peak impedance or resistance at the resonant frequency of each drive signal) (block 212). The computer 12 or testing equipment 14 may then determine whether the resonant frequencies of the speaker 18 for the at least two drive signals differs by a value that meets or exceeds a target frequency threshold (block 214). When the resonant frequencies of the speaker 18 for the at least two drive signals does not differ by a value that meets or exceeds a target frequency threshold ("No" branch of decision block 214), the computer 12 or testing equipment 14 may then determine whether the magnitude of the impedance or resistance for the resonant frequencies of the speaker 18 for the at least two drive signals differs by a value that meets or exceeds a target peak threshold (block 216). When the magnitude of the peaks at the resonant frequencies of the speaker 18 for the at least two drive signals does not differ by a value that meets or exceeds the target peak threshold ("No" branch of decision block 216), the computer 12 or testing equipment determines that the speaker 18 is acceptable (block 218) and the sequence of operations may end. However, when the resonant frequencies of the speaker 18 for the at least two drive signals differs by a value that meets or exceeds a target frequency threshold ("Yes" branch of decision block 214) or when the magnitude of the peaks for the resonant frequencies of the speaker 18 for the at least two drive signals differs by a value that meets or exceeds the target peak threshold ("Yes" branch of decision block 216), the computer 12 or testing equipment 14 determines that the speaker 18 is unacceptable (block 220) and the sequence of operations may end.

In still further embodiments, the resonant frequency or magnitude of the impedance of a speaker under test for a first cone excursion is compared to the resonant frequency or the magnitude of the impedance of a known good speaker for a second cone excursion, or compared to the average resonant frequency or average magnitude of the impedances of a plurality of known good speakers for the second cone excursion. This data for the speaker under test is compared to the data for the reference speaker(s). While it is normal for individual speakers to vary in resonance frequency or magnitude of the impedance at their resonant frequencies, the variations that result from defects or other issues are generally far beyond what is considered normal. For example, a speaker might normally have a resonance frequency that varies ±20% around a resonance frequency for a known good speaker for a drive signal of about 100 Hz. Embodiments of the invention may therefore be configured to accept speakers exhibiting normal variance of the resonant frequency and reject speakers that exhibit resonant frequency deviations from the norm, such as ±30% around the resonant frequency of a known good speaker at a particular drive level, or the average resonant frequency of a plurality of known good speakers at the particular drive level. In general, some preliminary testing has indicated that rejected speakers exhibit deviations of ±100% around a known good resonant frequency or average resonant frequency. Correspondingly, the magnitude of the impedance normally varies from speaker to speaker. As such, embodiments of the invention may be configured to accept speakers exhibiting normal variance of the magnitude of the impedance for a resonant frequency and reject a speaker that exhibits deviations in the magnitude of the impedance at the resonant frequency from the norm, such as a ±30% difference from the magnitude of the impedance of a speaker for its resonant frequency, or a ±30% difference from the average magnitude of the impedance of a plurality of speakers for their resonant frequencies.

In light of the foregoing, speaker defects may be determined with respect to multiple frequency sweeps of drives signals at different cone excursions for the same speaker. The data from one or more of the multiple sweeps is then compared to data from one or more different sweeps of the multiple sweeps at different cone excursions to determine whether the speaker under test is acceptable. Alternatively, speaker defects may be determined with respect to a single sweep of a drive signal for a speaker at a specific cone excursion. The data from the single sweep is then compared to data from one or more sweeps of one or more reference speakers (e.g., speakers known to be acceptable, or otherwise good) to determine whether the speaker under test is acceptable.

While the present invention has been illustrated by a description of embodiments thereof, and the embodiments have been described in considerable detail, it is not the intention of the applicants to restrict or in any way limit the scope of the appended claims to such detail. Additional advantages and modifications will readily appear to those having ordinary skill in the art.

By way of example, the computer 12 and testing equipment may include more or fewer components that those illustrated. Also by way of example, although the testing equipment 14 is illustrated as separate from the computer 12, one having ordinary skill in the art will appreciate that the testing equipment 14 may be internal to, or otherwise integral with, the components of the computer 12. As such, the computer 12 may utilize I/O interfaces or specialized hardware to produce the various drive signals, and similarly utilize I/O interfaces or specialized hardware to measure characteristics of the signals from the speaker 18. In those embodiments, the application 26 may be configured to utilize the components of the computer 12, and in specific embodiments may be the TRUERTA real time audio spectrum analyzer software distributed by True Audio of Andersonville, Tenn. Moreover, one having ordinary skill in the art will appreciate that the computer 12 or testing equipment 14 may determine that the speaker 18 is not acceptable when the difference between first and second resonant frequencies is equal to the target frequency threshold and/or when the different between the magnitude of the impedance or resistance at two resonant frequencies is equal to the target peak threshold.

The invention in its broader aspects is therefore not limited to the specific details, representative apparatus and method, and illustrative example shown and described. Accordingly, departures may be made from such details without departing from the spirit or scope of the general inventive concept.

Having described the invention, what is claimed is:

1. A method of testing a speaker, comprising:

applying a test drive signal to the speaker, the test drive signal comprising a brief frequency sweep signal in combination with a very low frequency audio tone having a fundamental frequency below 10 Hz;

determining first response parameters of the speaker associated with the test drive signal at a first cone excursion of the speaker;

determining second response parameters of the speaker associated with the test drive signal at a second cone excursion of the speaker; and comparing the first and second response parameters to determine whether they differ by more than a target threshold.

2. The method of claim 1, further comprising:

in response to determining that the first and second response parameters differ by a value greater than the target threshold, determining that at least one characteristic of the speaker is unacceptable.

3. The method of claim 1, further comprising:

in response to determining that the first and second response parameters differ by a value less than the target threshold, determining that at least one characteristic of the speaker is acceptable.

4. The method of claim 1, wherein the very low frequency tone has a fundamental frequency below 5 Hz.

5. The method of claim 1, wherein the very low frequency tone has a fundamental frequency below 1 Hz.

6. The method of claim 1, wherein the very low frequency tone has a shape selected from the group consisting of a sine wave shape, a square wave shape, and a clipped sine wave shape.

7. The method of claim 1, wherein the low frequency tone is produced at a plurality of amplitudes.

8. The method of claim 1, wherein the frequency sweep signal is a logarithmic frequency sweep signal.

9. An apparatus to test a speaker, comprising:

an audio band output having electrical terminals for connection to the speaker;

an audio power amplifier with extended low frequency response to approximately 0.2 Hz connected to the electrical terminals for connection to the speaker;

an audio band input;

at least one processing unit; and a memory, the memory containing program code configured to be executed by the at least one processing unit to:

output a test signal to the electrical output terminals, wherein the test signal comprises a very low frequency tone with a fundamental frequency below 10 Hz, receive a a measure of voltage and current at the electrical terminals for connection to the speaker, determine an impedance of the speaker from the measured voltage and current, and calculate characteristic parameters of the speaker including at least resonance frequency from the voltage and current.

10. The apparatus of claim 9, wherein the very low frequency tone has a fundamental frequency below 5 Hz.

11. The apparatus of claim 9, wherein the very low frequency tone has a fundamental frequency below 1 Hz.

12. The apparatus of claim 9, wherein the very low frequency tone has a shape selected from the group consisting of a sine wave shape, a square wave shape, and a clipped sine wave shape.

13. The apparatus of claim 9, wherein the low frequency tone is produced at a plurality of amplitudes.

14. A program product, comprising:

program code that is configured to produce a test drive signal for application to a speaker, the test drive signal comprising a brief frequency sweep signal in combination with a very low frequency audio tone having a fundamental frequency below 10 Hz;

determine first response parameters of the speaker associated with the test drive signal at a first cone excursion of the speaker;

determine second response parameters of the speaker associated with the test drive signal at a second cone excursion of the speaker; and compare the first and second response parameters to determine whether they differ by more than a target threshold; and a non-transitory computer recordable medium bearing the program code.

15. The method of claim 14, wherein the very low frequency tone has a fundamental frequency below 5 Hz.

16. The method of claim 14, wherein the very low frequency tone has a fundamental frequency below 1 Hz.

17. The method of claim 14, wherein the very low frequency tone has a shape selected from the group consisting of a sine wave shape, a square wave shape, and a clipped sine wave shape.

18. The method of claim 14, wherein the low frequency tone is produced at a plurality of amplitudes.

* * * * *